US006374579B1

(12) United States Patent
Muller

(10) Patent No.: US 6,374,579 B1
(45) Date of Patent: Apr. 23, 2002

(54) LINER BAG FOR FLEXIBLE BULK CONTAINER

(76) Inventor: Lance John Muller, 11 Malindi, Mala Close, Sunninghill Ext 97, Sandton (ZA)

( * ) Notice: Subject to any disclaimer, the term of this patent is extended or adjusted under 35 U.S.C. 154(b) by 0 days.

(21) Appl. No.: 09/719,006

(22) PCT Filed: Jun. 3, 1999

(86) PCT No.: PCT/ZA99/00039

§ 371 Date: Dec. 7, 2000

§ 102(e) Date: Dec. 7, 2000

(87) PCT Pub. No.: WO99/64324

PCT Pub. Date: Dec. 16, 1999

(30) Foreign Application Priority Data

Jun. 9, 1998 (ZA) ..... 98/5043
Dec. 9, 1998 (ZA) ..... 98/11254

(51) Int. Cl.[7] ..... B65B 11/58

(52) U.S. Cl. ..... 53/449; 53/479; 53/175; 53/417; 53/284.7; 383/120; 383/904; 493/186; 493/189

(58) Field of Search ..... 53/417, 456, 459, 53/469, 479, 175, 284.7, 370.6, 370.7; 493/189, 186; 383/111, 109, 120, 904

(56) References Cited

U.S. PATENT DOCUMENTS

| | | | | |
|---|---|---|---|---|
| D22,380 S | | 5/1893 | O'Reardon | |
| 2,522,200 A | | 9/1950 | Southwick | |
| 2,730,150 A | | 1/1956 | Wunderwald et al. | |
| D181,950 S | | 1/1958 | Winstead | |
| 3,299,927 A | | 1/1967 | Clarizio | |
| 3,367,380 A | | 2/1968 | Dickey | |
| 3,394,871 A | | 7/1968 | Williams et al. | |
| 3,395,623 A | | 8/1968 | Baker | |
| 3,462,067 A | | 8/1969 | Shore | |
| 3,889,449 A | | 6/1975 | Membrino | |
| 4,056,138 A | * | 11/1977 | Fagniart | 150/0.5 |
| D247,427 S | | 3/1978 | Fagniart | |
| 4,322,932 A | | 4/1982 | McGregor | |
| 4,341,054 A | * | 7/1982 | Courtheoux | 53/268 |
| 4,537,584 A | | 8/1985 | Everman et al. | |
| 4,541,765 A | | 9/1985 | Moore | |
| 4,596,040 A | | 6/1986 | LaFleur et al. | |
| 4,698,951 A | | 10/1987 | Everman et al. | |
| 4,747,703 A | | 5/1988 | Cazes | |
| 4,781,475 A | | 11/1988 | LaFleur | |
| 4,818,545 A | | 4/1989 | Kunimoto | |
| 4,872,493 A | | 10/1989 | Everman | |
| 4,874,258 A | | 10/1989 | Marino | |
| D308,164 S | | 5/1990 | Cazes | |
| 5,373,965 A | | 12/1994 | Halm et al. | |
| 5,443,102 A | * | 8/1995 | Svendsen | 141/10 |
| 5,639,164 A | | 6/1997 | Ishino et al. | |
| 5,690,253 A | | 11/1997 | LaFleur | |
| 5,758,473 A | | 6/1998 | Patelli | |
| 5,771,667 A | | 6/1998 | McGregor et al. | |
| 5,772,651 A | | 6/1998 | De Haen et al. | |
| 5,984,850 A | * | 11/1999 | Derby | 493/29 |
| 6,063,418 A | * | 5/2000 | Sugimoto et al. | 426/127 |
| 6,126,315 A | * | 10/2000 | Ichikawa et al. | 383/43 |

FOREIGN PATENT DOCUMENTS

| | | |
|---|---|---|
| DE | M 97 00 309.3 | 1/1997 |
| EP | 0 300 539 A1 | 1/1989 |
| EP | 0 581 393 A2 | 2/1994 |

* cited by examiner

*Primary Examiner*—Rinaldi I. Rada
*Assistant Examiner*—Thanh Truong
(74) *Attorney, Agent, or Firm*—Venable; George H. Spencer; Catherine M. Voorhees

(57) ABSTRACT

The design comprising bag (36) formed with deep side gussets (42, 44). It has a body portion and a neck. The front face, rear face and gussets are heat welded together at the base of the bag. At the neck (56) the front face is welded to the front sheets of the gussets and the rear face is welded to the rear sheets of the gussets so that the gusset can open at these parts. At the free ends of the neck (66) the front face, rear face and gussets are heat welded together to be held together when the bag is opened.

10 Claims, 9 Drawing Sheets

LINER BAG FOR FLEXIBLE BULK CONTAINER

This invention relates to plastic bags and to methods of filling them.

The invention is concerned with such plastic bags which are used as liners (hereinafter called "liner bags") for bulk bags for containing free flowing moisture sensitive granular material. Hitherto such liner bags were used especially but not exclusively to line one tonne bulk bags for sugar. The bulk bags are normally woven plastics bags of sufficient strength to carry such content and when filled with free flowing granular material take up a cuboidal form. The upper surface of the bulk bag is open and a closure flap means is provided which span this open surface when the bulk bag has been filled to provide a closure therefor. Loops are provided at the corners of the bulk bags so that they may be lifted by the forks of a fork lift truck. The liner bag is used to contain the granular material and to protect the contents against ingress of contaminants and of air containing moisture and consequent formation of lumps of sugar because of the water content of the air.

In known arrangements the liner bag is formed from blown plastic tube normally formed with deep gussets so as to be able to take up the cuboidal shape. In the lie flat condition, the liner bag comprises a front panel and a rear panel and each gusset comprises a front gusset part and a rear gusset part, the side edges of the front panel being joined to the front gusset parts and the side edges rear panel being joined to the rear gusset parts. The liner is longer than the bulk bag and is of constant width. Its upper end is not sealed. The liner bag is inserted into the bulk bag and its upper end is opened to receive the filler nozzle through which sugar is delivered into the liner bag. In many cases initially a blast of air causes the liner bag to expand whereafter the granular material is fed into the liner bag through the nozzle. After filling the liner bag, in most cases, is vibrated causing the sugar settle to a maximum level. The upper portion of the liner bag is wound around and twisted after which it is wire tied and knotted or taped to seal it. To transport the material, the bulk bag is lifted by the loops and the upper portion of the liner bag may also form a retaining part that is also secured to the lifting device. The base of the bulk bag has an opening therein normally closed by a bottom flap. To discharge the contents of the bulk bag, it is located above the material receptacle. The top opening is opened, the wire ties and tape are removed and the knot undone. The bottom flap is opened and the liner bag is pierced so that the sugar will flow out of the liner bag.

Such a system is widely used in the sugar industry. It does however suffer from a number of disadvantages. First, the knot (together with the wire ties and the adhesive tape) often does not provide an adequate seal so that the sugar may be contacted by the water content in the ambient air so that it becomes lumpy. Second, it is relatively easy to undo and re-tie the wire ties and the knot so that the bulk bags are liable to pilferage which cannot be easily visually detected.

U.S. Pat. No. 4,341,054 (Courtheoux) discloses heat welding the mouth of a plastic bag. The bag is small, being designed to accommodate 2500 gm of liquid syrup and is not gusseted. Thus there are no undue technical difficulties in heat welding the bag. However it is not possible to adapt this teaching to liner bags for bulk bags because the length of the required heat weld would be of the order of two metres and the liner bags would be deeply gusseted. In practice it has hitherto been extremely difficult to place the various panels of the liner bag flat and close together and consequently there will be folds in the plastic sheeting which will prevent the formation of a satisfactory moisture proof sealing of the plastic parts. In particular it would not be possible to do so speedily as would be required for normal commercial operation.

U.S. Pat. Nos. 4,596,040 and 4,781,475 (La Fleur et al) disclose a liner for a bulk bag. The bulk bag is of a particular shape with a nozzle or throat at its upper end and the liner bag is shaped to correspond to the shape of the bulk bag. The liner bag is heavily gusseted to take up the cuboidal shape and has a reduced dimensioned neck into which the gusset extends. The nozzle is closed by being tied off by a cord. This suffers from the disadvantages of inadequate sealing and liability to pilferage as mentioned above.

According to one aspect of the invention there is provided a liner bag comprising a front panel, a rear panel and gussets between the sides of the panels, each gusset comprising a front gusset part and a rear gusset part, the side edges of the front panel being joined to the front gusset parts and the side edges of the rear panel being joined to the rear gusset parts, the liner bag comprising a body part and a neck at its upper end, which neck is adapted to receive therein a filling nozzle and which neck can be heat sealed after the liner bag has been filled to seal liner bag, the neck being formed by welding together the edges of the front panel to the front gusset parts and by welded together the edges of the rear panel to the rear of gusset parts; wherein the front and rear panels and the gusset parts are all welded together only at the free end of the neck.

According to another aspect of the invention there is provided a method of manufacturing a liner bag as set out in the preceding paragraph comprising forming a gusseted lay flat tube; passing the tube over a welding table; by means of a welding unit, welding the tube to form the neck; and interposing blanking pieces between the front and rear parts of the gussets to prevent the front panel and front gusset parts from being welded to the rear panel and rear gusset part and locating such blanking pieces so that they, the blanking pieces, are spaced from the end of the neck with the result that the front panel, the front gusset parts, the rear gusset parts and the rear panel are welded together at such spaced locations.

According to a further aspect of the invention there is provided a method of filling a bulk bag with free flowing material e.g. sugar, in which a liner bag, as set out in the preceding paragraph but one, is inserted into the bulk bag, the neck is opened and placed around the filler nozzle of a bulk filling machine, and the liner bag is filled, wherein inward pressure is then applied between the gusset parts to re-form the gussets and cause the panels and gusset parts to lie flat against one another and then heat sealing the panels and the gusset parts at the part of the neck near the body part to seal the liner bag closed.

According to a further aspect or the invention there is provided the combination of a bulk bag containing therein a liner bag of the invention as set forth above, the bulk bag having an open top and flap means which closes the open top when the bag is filled.

Embodiments of the invention will now be described by way of example with reference to the accompanying drawings.

Figure 2:
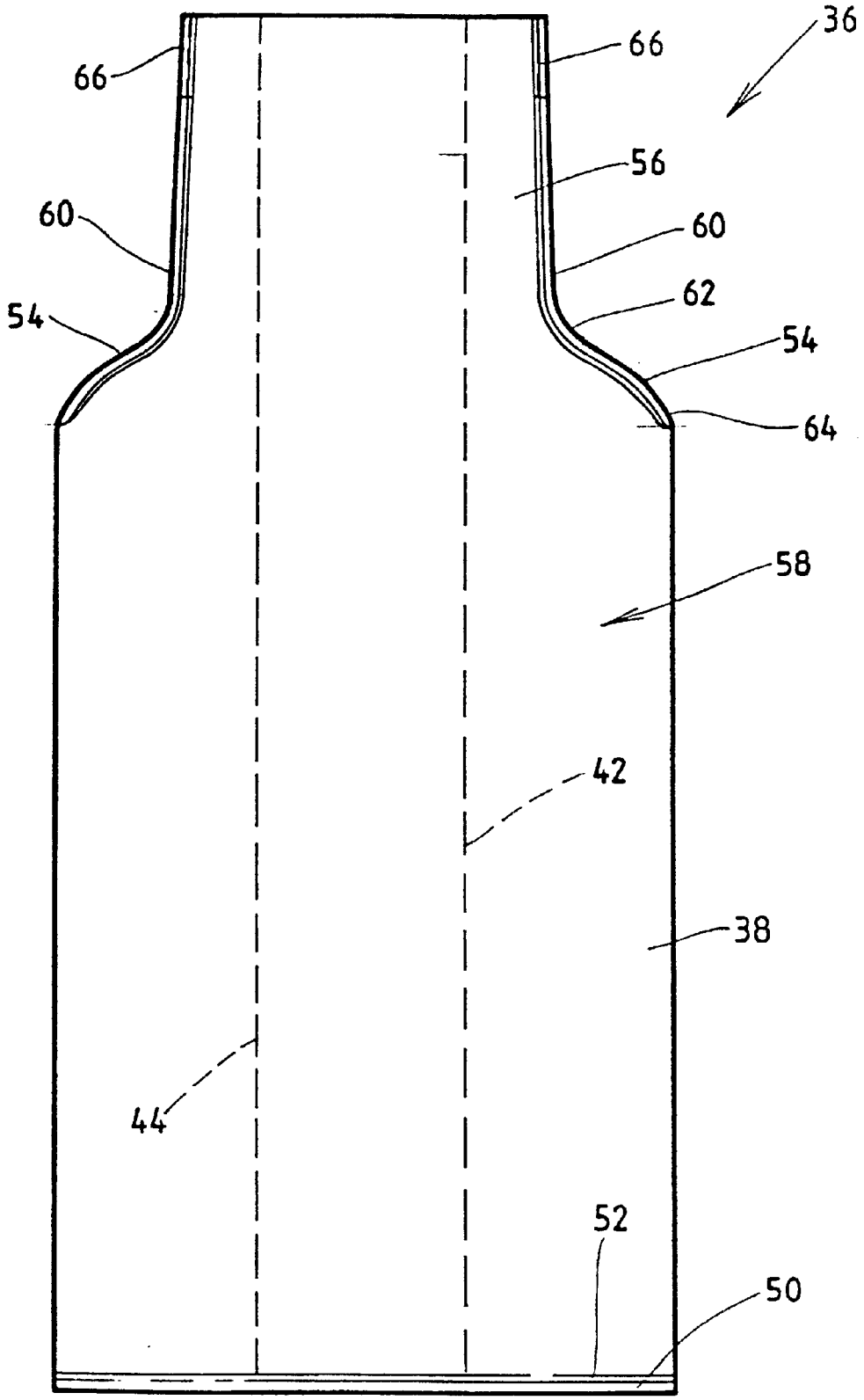
FIG. 2 is a plan view of a liner bag in the lay flat condition.
Figure 3:
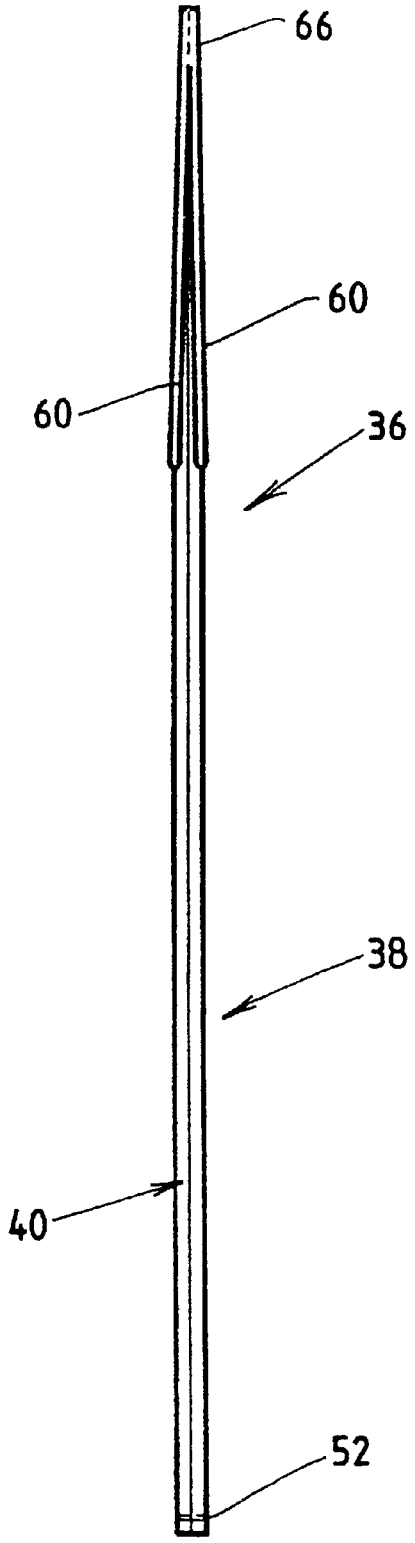
FIG. 3 is a side view of the liner bag in the lay flat condition.
Figure 4:
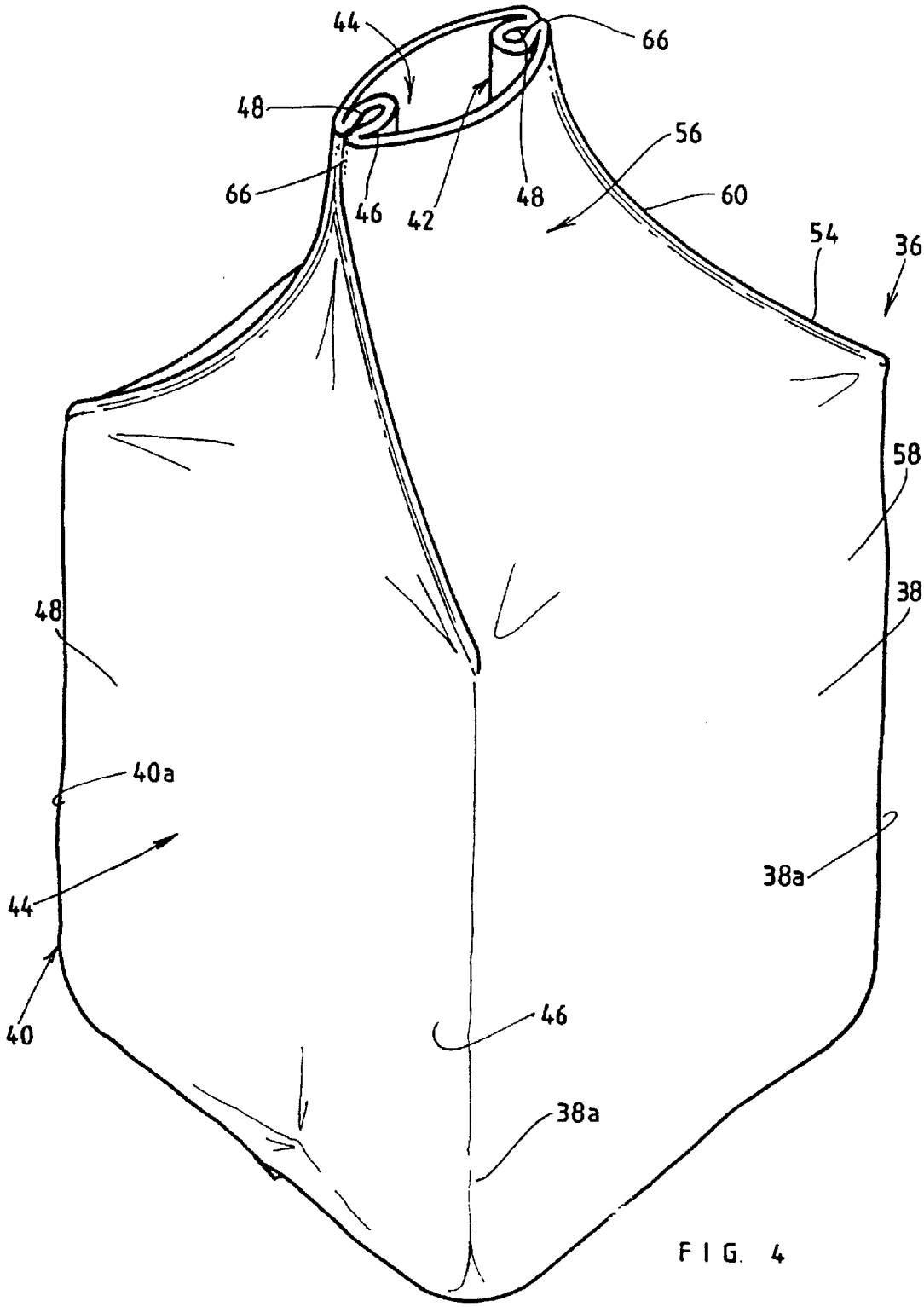
Figure 5:
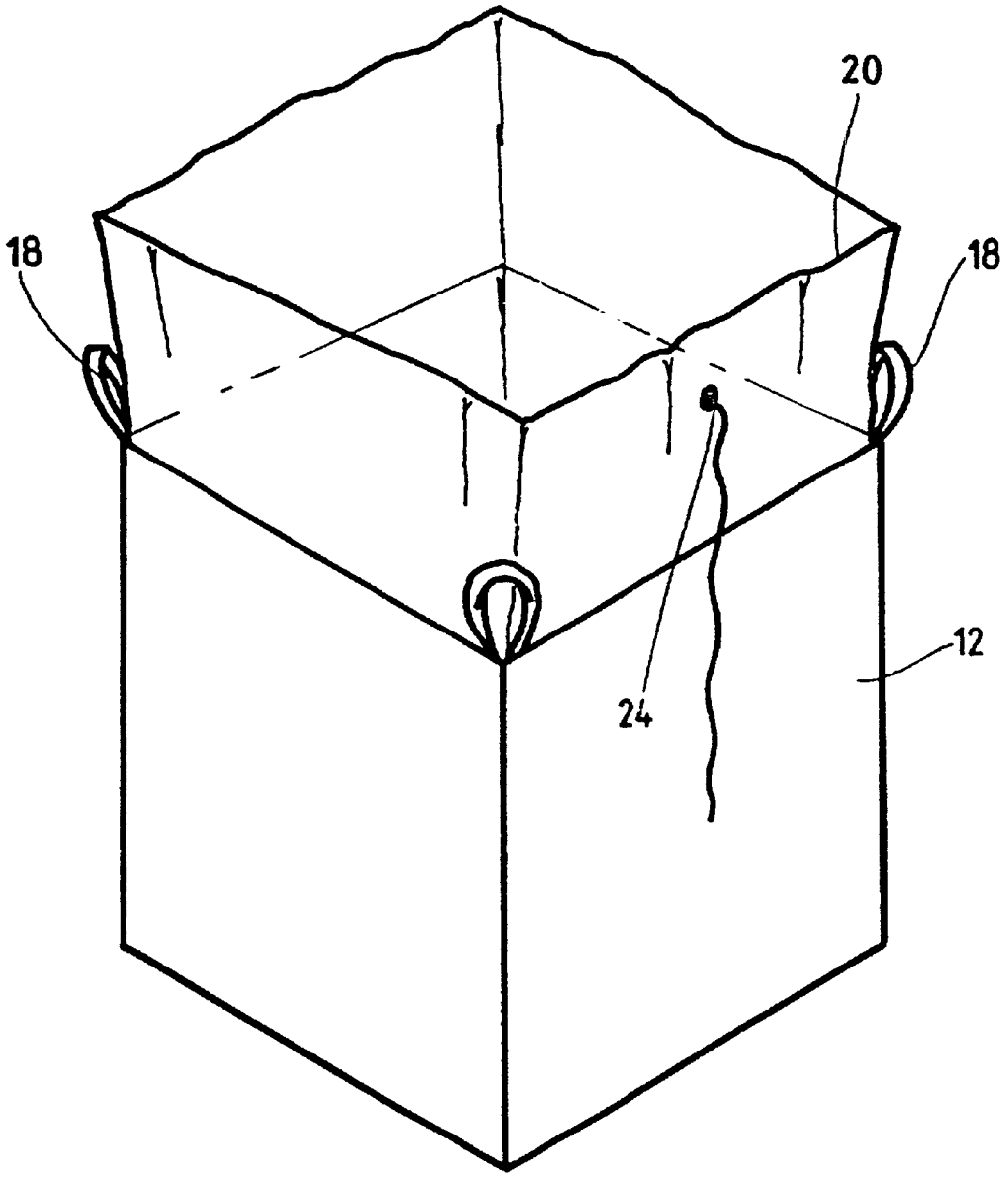
Figure 6:
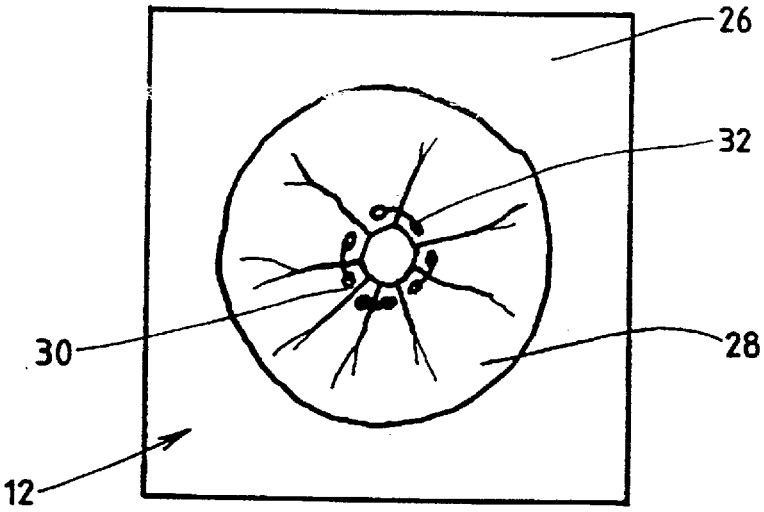
Figure 7:
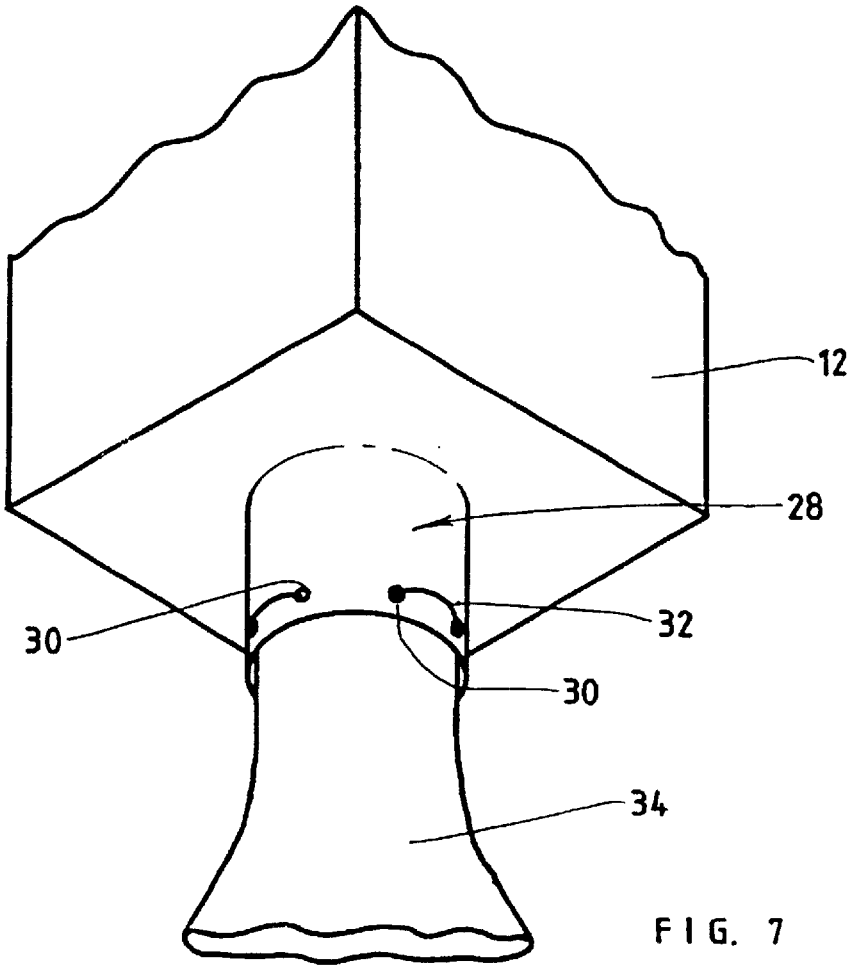
Figure 8:
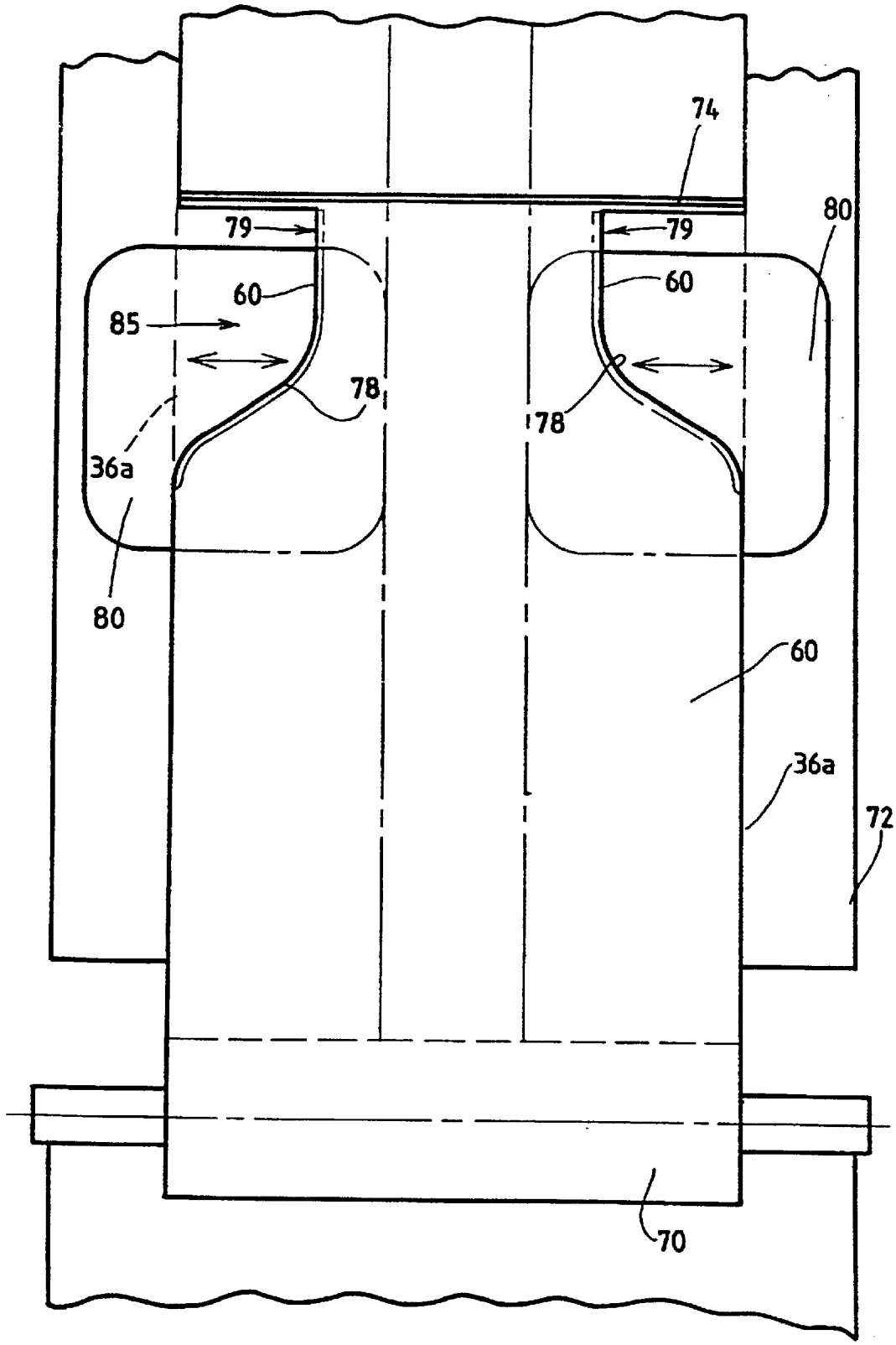
Figure 9:
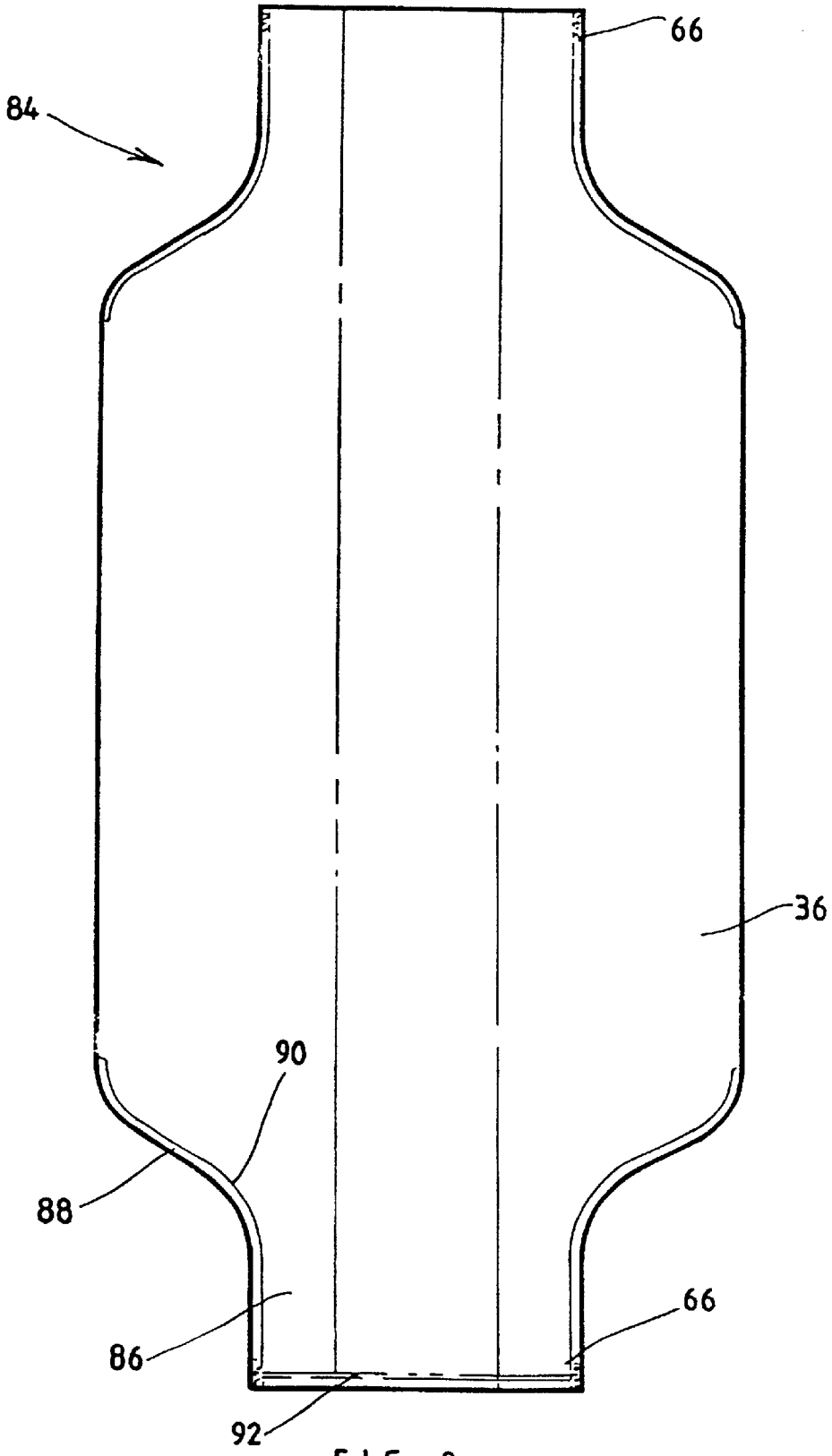
Figure 10:
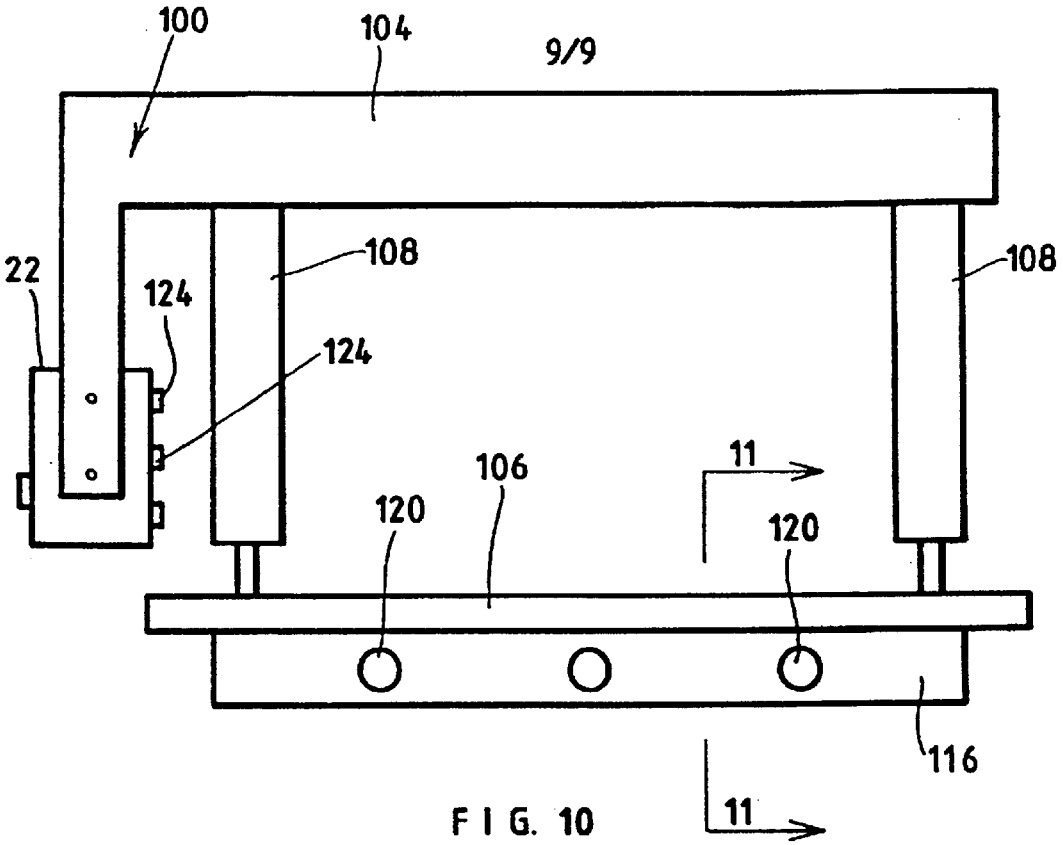
Figure 11:
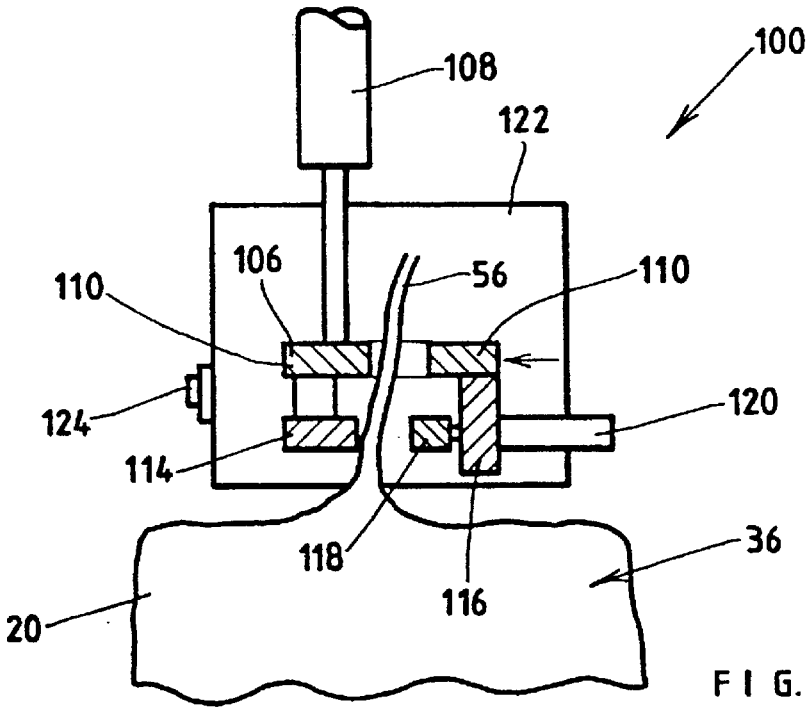

FIG. 4 is a perspective view of the liner bag in the partially filled condition, FIG. 5 is a perspective view of a bulk bag, FIG. 6 is an underplan view of the bulk bag showing the outlet neck in the closed position, FIG. 7 is a perspective view of the underside of the bulk bag with the discharge nozzle extended, FIG. 8 is a diagrammatic plan of the manufacturing table on which the liner bag is made, FIG. 9 is a view similar to FIG. 2 of a modified liner bag of the invention, FIG. 10 is a back view of a sealing unit, and FIG. 11 is a section on line 11—11 of FIG. 10 showing the sealing unit in use applying a heat seal to the neck of the liner bag.

Figure 1:
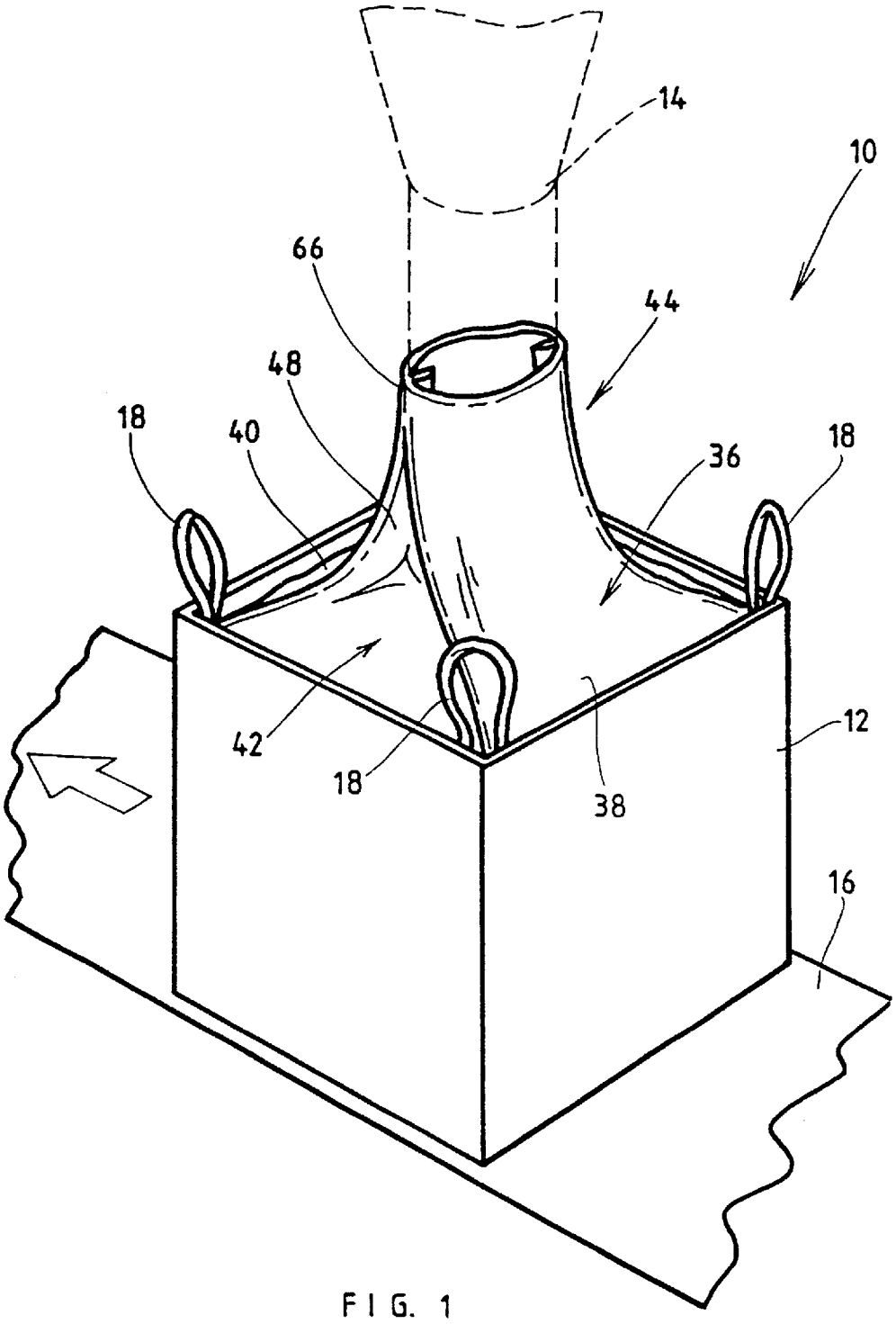
FIG. 1 shows diagrammatically the filling of a sugar bulk bag.

Referring now to FIG. 1, there is shown a filler station 10 for filling a bulk bag 12 with sugar. The filler station 10 includes a 400 mm o/d nozzle 14 leading from a sugar hopper or silo (not shown) and a conveyor 16 on which the bulk bag 12 is delivered to below the nozzle 14.

The bulk bag 12 comprises a bag formed of woven polypropylene and incorporating four loops 18 by means of which the bulk bag may be lifted by a fork lift carrier. The upper end of the bulk bag 12 is open. The walls of the bulk bag have a top extension 20 (see FIG. 5). A cord 24 is provided for tying extension parts together to close the opening. At the bottom end 26, the bag 12 has a cylindrical release nozzle or neck 28 (see FIGS. 6 and 7). Eyelets 30 are provided near the end of the release nozzle 28. A draw cord 32 passes through the eyelets 30 to draw the neck nozzle 28 closed to form a continuation of the bottom end 26 of the bag. An extension skirt 34 of more flexible material extends from the end of the neck or nozzle 28. When the neck is being collapsed, the material of the skirt 34 serves to assist closing off the opening surrounded by the nozzle or neck 28. The bulk bag 12 is of an appropriate size to contain one thousand kilograms (one tonne) of sugar. It is of approximately cuboidal shape (and will be referred to as a cube herein).

As thus far described the parts are conventional and known to those skilled in the art.

Within the bulk bag 12 is a liner bag 36. The liner bag 36 is a heavily gusseted plastic bag formed from blown plastic tubing and comprising, in the lay flat condition, a front panel 38 and a rear panel 40. Each gusset 42 and 44 comprises a front gusset panel or part 46 and a rear gusset panel or part 48 (best shown in FIG. 4). The side edges 38*a* of the front panel 38 merge with the side edges of the front gusset parts 46 and the side edges 40*a* of the rear panel 40 merge with the side edges of the rear gusset parts 48. The material of the liner is low density polyethylene or linear low density polyethylene of 100 $\mu$m (one hundred micron) thickness. The bottom edge 50 of the liner bag 36 is sealed off by a double seal 52 which seals together the bottom edges of the front and rear panels and the gusset parts.

The upper edge 54 of the liner bag 36 is partially closed and leads to an elongated neck 56 that extends over a small portion of this upper edge 54, thus forming the liner bag into a body 58 and a neck 56 with the edge 54 at the join therebetween. The upper edge 54 has a curved concave portion 62 leading to the neck 56. The outer parts 64 of the upper edge 54 are curved convexly downwards towards the bottom of the liner bag 36. The gussets 42 and 44 extend into the neck 56. At the upper edges 54 and the side edges 60 of the neck 56, the front panel 38 is heat welded to the outer edges of the front gusset parts 46 and the rear panel 40 is heat welded to the outer edges of the rear gusset parts 48. The front and rear panels and the front and rear gusset parts are not welded together at these edges except as will be described. The size of the neck 56 is such that when expanded it is of sufficient size to fit relatively closely over the filling nozzle 14 to which it may be secured as will be described. At the upper or free end of the neck 56 there are short welds 66 connecting together the front panel 38, the front and rear gusset parts 46 and 48 and the rear panel 40.

The effect of the deep gussets 42 and 44 is that when the liner bag 36 is filled, the body 58 takes a substantially cube shape. All welds are double welds for requisite strength purposes.

A suitable clamping device (not shown) clamps the neck 56 to the filling nozzle 14. An air release valve (also not shown) is provided in the filling nozzle to permit the escape of air in the liner bag 36 which is displaced by the sugar.

A sealing unit 100 (see FIGS. 10 and 11) is provided for sealing the neck 56. The unit 100 comprises a pair of jaws carried from a top bar 104 fixed above a position on the conveyor beside the filler station. The top bar 104 carries a cross member 106 at its ends by means of a pair of widely spaced pneumatic cylinders 108 which permit the cross member 106 to move upwards and downwards under the control of a workman. The cross member 106 has two spaced bars 110 connected together at its ends. The cross member 106 carries a fixed jaw 114 and carrier bar 116. The carrier bar 116 carries a movable sealing jaw 118 by means of three pneumatic cylinders 120. A control box 122, having the appropriate control buttons 124, is carried at one end of the top bar 104.

In use, the bulk bag 12, with the liner bag 36 therein, is brought to the filler station 10 adjacent to the filling nozzle 14. The neck 56 is fitted over the filling nozzle 14 with the welds 66 manipulated to be in positions at opposite ends of a diameter of the filling nozzle 14 which is parallel to the front and rear panels 38 and 40 (and the walls of the bulk bag 12 against which they will lie when the liner 36 is filled). The neck 56 is secured to the filling nozzle e.g by a binding cord or the like. A short blast of air expands the liner bag 36. Sugar is now delivered through the nozzle 14 via the neck 56 into the body 58 of the liner bag 36. When the appropriate amount of sugar has been delivered, the liner bag 36 will be filled up to the upper edge 54 of the liner bag 36. Because of the provision of the gussets 42 and 44, the liner bag 36 will take up a generally cuboidal shape (as is shown in FIG. 1). The bulk bag 12 is vibrated so that the sugar will spread and the upper surface of the sugar will be flattened from the coned position that it takes up due to delivery from the filling nozzle 14. Workmen on opposite sides of the filling nozzle now push lightly into the join of the gusset parts 46 and 48 which causes the gussets 42 and 44 to collapse and all the panels to lie flat against each other re-forming to its original lay flat condition. The neck will be folded over to lie flat on the body of the liner bag.

The bulk bag 12 is moved to the next station at which the sealing unit 100 is located. The neck panels 56, which now lie flat against each other, are threaded through the gap between the fixed and movable sealing jaws 114 and 118 and the gap between the bars forming the cross member, the cross member 106 having been drawn downwardly to close to the upper surface of the filled liner bag 20. On application of the appropriate control button 124, the movable sealing jaw 118 is moved towards the fixed jaw 114 and the neck sealed closed. The movable jaw 118 is caused to move away and the upper part of the neck 56 is removed from the gap between the jaws there being a short length of neck below the seal. The cylinders 108 lift the cross member 106 to its rest position.

The bulk bag 12 is now moved to the next station where the cord 24 wrapped around the extension flaps 20 to tie them closed.

The time of the filling cycle i.e. from bringing the bulk bag 12 to the filling station 10 and moving it to the next station and replacing it by the next bag will be of the order of forty (40) seconds.

The sugar can be stored and transported in the liner bags 36 within the bulk bag 12. When it is desired to discharge the sugar, the bulk bag 12 is lifted over the hopper or other receptacle into which the sugar is to be delivered. The cord 32 is released permitting the discharging nozzle or neck 28 to take up its discharge position (as shown in FIG. 7). The extension flaps 20 are opened and the upper end of the liner bag is cut. A knife or spear cuts through the exposed part of the liner bag 36 at the discharge neck 28 and the sugar escapes through the opening thus formed and is delivered to the receptacle. We have found by piercing the upper end of the liner bag, air will flow into the liner bag as the sugar is discharged and that the liner bag 36 is not drawn down with the sugar during discharge but remains within the bulk bag 12.

The dimensions of the liner bag 36 are (in the lay flat condition) as follows: width 1200 mm, depth of gussets 400 mm, height (i.e. between the edge 50 and the lowest part of the edge 54) 1950 mm, width of neck 760 mm, length of neck 800 mm and distance from the join of the front edge 54 to the side edges of the panels to the beginning of the neck is 250 mm. The length of the short welds is 150 mm. A liner bag of these dimensions will accept one tonne of sugar.

The plastic material of which the liner bag 36 is made, contains a sufficient amount of anti-blocking agent so that the neck 56 can be easily and quickly opened for fitting on to the nozzle 14.

The lay flat material 68 from which the liner bags 36 are made is provided on a roll 70 (see FIG. 8) rotatably mounted at one end of a metal welding table 72 over which the material 68 is drawn. A shaped welding unit is supported in a manner known per se and is moved downwardly to weld the various parts of the material together The position of a unit is indicated by the weld lines that it forms and the construction thereof will be understood by those skilled in the art. The unit has a cross piece 74 that forms the transverse double seal 52. Further, the unit comprises two side pieces 78 that each form a part of the upper edge 54 and a side 60 of the neck 56. Secured to the table 72 are two blanking sheets 80 of "Teflon"® which are located respectively within the gussets 42 and 44. These sheets 80 blank off the weld lines of the side pieces 78 except for a short space 79 adjacent to the cross piece 74. Thus when the unit acts on the lay flat tube, the side pieces 78 will weld together the front and rear panels 38 and 40 respectively to the front and rear gusset parts 46 and 48 and, only at the said space 79 will weld the front and rear panels and the front and rear gusset parts all together. Workmen on either side of the table 72 now pull away the material between the welds formed by the unit and the edges 36*a* of the liner bag 36. This material will comprise about ten per cent (10%) of the material of the liner bag and is sent away for re-processing. The material is moved forwardly and is cut between the bottom seal 52 and the top of the neck 56.

Reference should be made to FIG. 9 in which is shown a liner bag 84 that is adapted to contain cement. The liner bag 84 is similar to the liner bag 36 save that a discharge neck 86 is provided at the lower end. The shape of the lower edge 88 and discharge neck 86 replicates the shape of the upper edge 54 and neck 56. The welds 90 forming such edge 88 and neck 86 however extend to join together all four panels i.e. the front panel, the front gusset part, the rear gusset part and the rear panel. Further the end of the neck 86 is closed by a cross-weld 92.

The liner bag 84 may be made of sufficiently strong material so as to serve as a container bag without the necessity of using the bulk bag.

We have found that because the neck 26 is relatively narrow, the panels will lie flat against each other with a minimum of, or indeed total elimination of, folds and creases. Thus the sealing of the material of the neck can be effected quickly and efficiently. The seal will be such that there can be no ingress of contaminants, air or water into the granular material within the liner bag 20. Furthermore it is not possible to remove any of the granular material without damaging the liner bag which will minimize pilferage.

We have found that the bags above mentioned can be filled each with one tonne of product at the rate of forty five per half hour, i.e. at about one every forty seconds. Because of the fact that the upper portions of the side edge of the neck are welded together at 66, the neck 56 collapses easily and quickly when treated as mentioned above. This is of considerable importance as otherwise the panels and gusset parts may incorporate folds so that proper sealing of the material is not possible. In this connection it should be borne in mind that it is extremely difficult otherwise to collapse the neck and all the more so if one endeavours to do so within the time constraints mentioned above.

We have found surprisingly with the sugar filled liner bag 36, liquid collects in the folded over neck of the liner bag. Thus not only is the content of the liner bag protected from the ingress of water laden air, but also is dried because the liquid in the sealed liner bag finds its way into the neck.

It will be noted that there is a minimum of action taken by hand at the neck of the liner bag during sealing and discharge. Thus the possibility of extraneous matter dropping into the liner bag, as happened hitherto, is virtually eliminated.

The invention is not limited to the precise constructional details hereinbefore described and illustrated in the drawings. For example the liner bag can be used as a liner bag for bulk bags for any other free flowing product such as salt, achaar and other products including chemicals. The dimensions of the various parts can be varied as desired and the liner bags can be designed for bulk bags of different capacities. The wall thickness of the lay flat tube may be different. Thicknesses as low as 40 $\mu$m have been used. It is important of course that the walls of the liner bag are of adequate strength. The liner bag can be made of any other suitable plastic material such as polypropylene or of co-extruded plastics.

The liner bag can be used with different bulk bags including bulk bags having only two closure flaps, neck arrangements and simple cord devices to wrap around the neck or closure flaps to close off the top of the bulk bag. The bulk bag can have an upper opening similar to the discharge neck. The liner bag can be used with crates or other containers to contain and store any other moisture sensitive free flowing granular material.

The liner bag can also be used as a bulk bag for smaller or other amounts of material provided that the material whereof the liner bag is made is of sufficient strength and thickness.

What is claimed is:

1. A liner bag comprising:

a front panel having side edges, a rear panel having side edges, and gussets between the side edges of the front and rear panels, each gusset comprising a front gusset part and a rear gusset part, the side edges of the front panel being joined to the front gusset parts and the side edges of the rear panel being joined to the rear gusset parts, the liner bag having a body part and a neck at its upper end, which neck is adapted to receive therein a filling nozzle and which neck can be heat sealed after the liner bag has been filled to seal the liner bag, the neck being formed by sealing together the edges of the front panel to the front gusset parts and by sealing together the edges of the rear panel to the rear of gusset parts;

wherein the front and rear panels and the gusset parts are all sealed together only at the free end of the neck.

2. A liner bag as claimed in claim 1, wherein the gusset parts are welded together by short welds, the length of the short welds being less then 20% of the length of the neck.

3. A liner bag as claimed in a claim 1, further comprising an upper edge at the join of the body and the neck wherein the upper edge is curved and convex at its outer ends.

4. A method of manufacturing a liner bag as claimed in claim 1 comprising the steps of:

forming a gusseted lay flat tube;

passing the tube over a welding table;

welding the tube to form the neck by means of a welding unit; and interposing blanking pieces between the front and rear parts of the gussets to prevent the front panel and front gusset parts from being welded to the rear panel and rear gusset parts; wherein the blanking pieces are located so that they, the blanking pieces, are spaced from the end of the neck with the result that the front panel, the front gusset part, the rear gusset part and the rear panel are welded together at spaced locations.

5. A method of manufacturing a liner bag as claimed in claim 4 wherein the welding unit seals the end of the adjacent liner bag at the same time as it forms the neck.

6. A method of filling a bulk bag with free flowing material in which a liner bag as claimed in claim 1 is inserted into the bulk bag, the neck is opened and placed around the filler nozzle of a bulk filling machine, and the liner bag is filled wherein inward pressure is applied to the sides of the neck between the gusset parts to re-form the gussets and to cause the panels and gusset parts to lie flat against one another, and the panels and the gusset parts are heat sealed at the lower part of the neck to seal the liner bag closed.

7. The combination of a bulk bag containing therein a liner bag as claimed in claim 1, wherein the bulk bag has an open top and a flap which closes the open top when the bag is filled.

8. A liner bag as claimed in claim 2, further comprising an upper edge at the join of the body and the neck, wherein the upper edge is curved and convex at its outer ends.

9. A liner bag comprising:

a front panel having side edges;

a rear panel having side edges; and gussets between the side edges of the front and rear panels, each gusset comprising a front gusset part and a rear gusset part, the side edges of the front panel being joined to the front gusset parts and the side edges of the rear panel being joined to the rear gusset parts, the liner bag having a body part and a neck at its upper end, which neck is adapted to receive therein a filling nozzle and which neck can be heat sealed after the liner bag has been filled to seal the liner bag, the neck being formed by welding together the edges of the front panel to the front gusset parts and by welding together the edges of the rear panel to the rear of gusset parts;

wherein the front and rear panels and the gusset parts are all welded together by short welds, the length of the short welds being less then 20% of the length of the neck.

10. A method of manufacturing a liner bag having a front panel having side edges, a rear panel having side edges, and gussets between the side edges of the front and rear panels, each gusset including a front gusset part and a rear gusset part, the side edges of the front panel being joined to the front gusset parts and the side edges of the rear panel being joined to the rear gusset parts, where the liner bag has a body part and a neck at its upper end, which neck is adapted to receive therein a filling nozzle and which neck can be heat sealed after the liner bag has been filled to seal the liner bag, and the neck is formed by welding together the edges of the front panel to the front gusset parts and by welding together the edges of the rear panel to the rear of gusset parts so that the front and rear panels and the gusset parts are all welded together by short welds only at the free end of the neck; and the method comprising the steps of:

forming a gusseted lay flat tube;

passing the tube over a welding table;

welding the tube to form the neck by means of a welding unit; and interposing blanking pieces between the front and rear parts of the gussets to prevent the front panel and front gusset parts from being welded to the rear panel and rear gusset parts; wherein the blanking pieces are located so that they, the blanking pieces, are spaced from the end of the neck with the result that the front panel, the front gusset part, the rear gusset part and the rear panel are welded together at spaced locations.

* * * * *